United States Patent [19]

Krauss

[11] 4,282,634

[45] Aug. 11, 1981

[54] BUCKLE

[76] Inventor: Jack Krauss, 14 Tanglewood La., Freeport, N.Y. 11520

[21] Appl. No.: 106,279

[22] Filed: Dec. 21, 1979

[51] Int. Cl.[3] ..... A44B 11/25; A44B 17/00

[52] U.S. Cl. ..... 24/230 R; 24/313

[58] Field of Search ..... 24/230 R, 77 R, 75

[56] References Cited

U.S. PATENT DOCUMENTS

| | | | |
|---|---|---|---|
| 3,200,464 | 8/1965 | Cousins | 24/230 R |
| 3,798,711 | 3/1974 | Cousins | 24/230 R |
| 3,844,000 | 10/1974 | Hedu | 24/230 R |
| 3,967,351 | 7/1976 | Rosenberg et al. | 24/230 R |
| 4,035,877 | 7/1977 | Brownson et al. | 24/230 R |

*Primary Examiner*—Roy D. Frazier
*Assistant Examiner*—Alexander Grosz
*Attorney, Agent, or Firm*—Kane, Dalsimer, Kane, Sullivan and Kurucz

[57] ABSTRACT

A buckle is disclosed, particularly for use in conjunction with belts, straps and the like. The buckle includes two mating parts which lock together upon insertion of a male member into a female member. The male member is generally rectangular in shape and has a slotted end suitable for receiving a belt or strap. The body of the male member includes a projecting portion extending at an angle from the plane of the body. The projecting portion is capable of movement about its point of attachment to the body. The female member is generally rectangular, and includes a slot therein for receiving the male piece. The slot is defined by a pair of opposing surfaces which the projecting portion can snap behind upon insertion. An opening is provided in the female member to allow the user to apply pressure to the projecting portion and remove the male member therefrom. A lip is provided to prevent the projection from slipping. A second opening is provided in the female member for the insertion of a belt or strap.

6 Claims, 5 Drawing Figures

BUCKLE

BACKGROUND OF THE INVENTION

The field of the invention relates to buckles for use in conjunction with belts, straps, suspenders, and similarly shaped members.

Buckles are commonly used for fastening seat belts, straps, harnesses, and other equipment. A strap may be pulled through the buckle to a desired tightness around a person or piece of equipment. Gripping means provided within the buckle will prevent the strap from loosening.

Buckles comprising two separable members are desirable where it is necessary to open a strap to release the person or equipment. U.S. Pat. Nos. 3,196,878, 3,251,110, 3,798,711 and 3,844,000 disclose buckles or fasteners having detachable members. When one wishes to free himself from a strap or harness, a release mechanism is actuated to separate the two members of the buckle.

SUMMARY OF THE INVENTION

The invention is directed to an improved buckle including two separable members. Such buckles have a wide variety of applications and have gained commercial acceptance. A principal object of the invention is to provide a structurally and functionally acceptable buckle of equal, if not better performance than presently known devices.

The buckle includes two mating parts. A male member is provided which is capable of insertion within a suitably formed female member. Means are provided for releasably coupling the two members.

The male member includes a substantially plate-like portion having a projection emanating upwardly at an angle from one side thereof. A pair of stops are provided on each side of the plate-like portion. The stops are positioned near one end thereof and function in a manner explained below.

A slotted, relatively thick member is provided at the end of the plate-like portion including the stops. It may be formed integrally with the plate-like portion, and defines a shoulder on each side of said portion. The width of the thick member is also greater than the width of the plate-like portion.

The female member includes an opposing pair of parallel structures defining a slot therebetween. The slot is of suitable dimensions for accommodating the plate-like portion of the male member. The parallel structures are substantially identical, and each has the cross section of a widened U. They may be joined together at a seam or integrally molded. Each structure has a pair of openings substantially perpendicular to the slot between them. The openings are defined by the peripheral walls of the structure and crossing pieces between the longitudinal edges.

A serrated column is positioned within the slot adjacent one of the openings in the female member. The other opening, which is nearest the point at which the male member enters the slot, includes a rearwardly extending lip. The lip is designed for preventing the angular projection from being forced over one of the parallel structures of the female member when the buckle is subjected to high tensile forces.

The entrance portion of the slot within the female member is provided with shoulders or notches which are appropriately shaped for receiving the stops of the male member. By having similar dimensions to the stops, there is less play between the members.

DETAILED DESCRIPTION OF THE INVENTION

Figure 1:
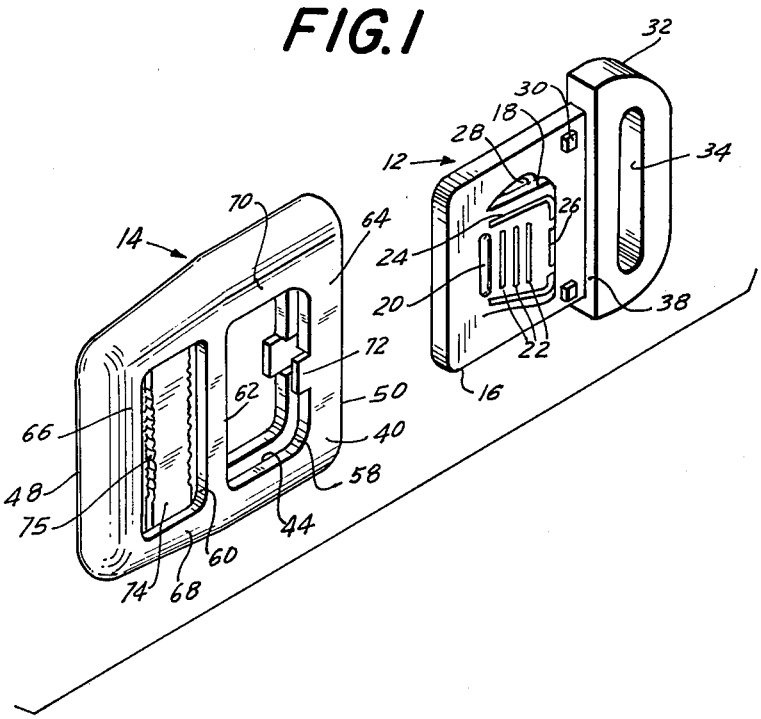
FIG. 1 is an exploded perspective view of a buckle according to the invention.

The invention is directed to a buckle 10 including two detachable members. A male member 12 is provided for insertion within a female member 14. The male member 12 includes a substantially plate-like portion 16 having a projection 18 emanating therefrom. The projection 18 forms an acute angle with the plate-like portion 16, and may be integrally formed therewith. The base portion of the projection includes a grooved area 20 which reduces its thickness at this point. A similar groove 21 may be formed at the opposite side. By manufacturing the buckle from a suitable polymeric material having sufficient resiliency, the projection will be movable about its base at the area of reduced thickness. The angle it makes with the plate-like portion 16 will accordingly change depending upon the presence or absence of a force applied thereto. Acceptable materials for manufacture are described in the prior art patents noted above.

A series of parallel ridges 22 is provided on the projection 18. A slightly higher ridge 24 surrounds these ridges 22. This ridge 24 is interrupted by and partially defines a groove 26 near the top of the projection 18.

To facilitate the movement of the projection 18, it extends over a cut out area 28 of the plate-like portion 16. The projection flares outwardly towards its top as does the cut out area.

A pair of stops 30 protrude from the planar surface of the plate-like portion 16. In the embodiment shown in the drawings, the stops have a square cross-sectional configuration. A second pair of stops (not shown) is positioned opposite the first pair.

Figure 2:
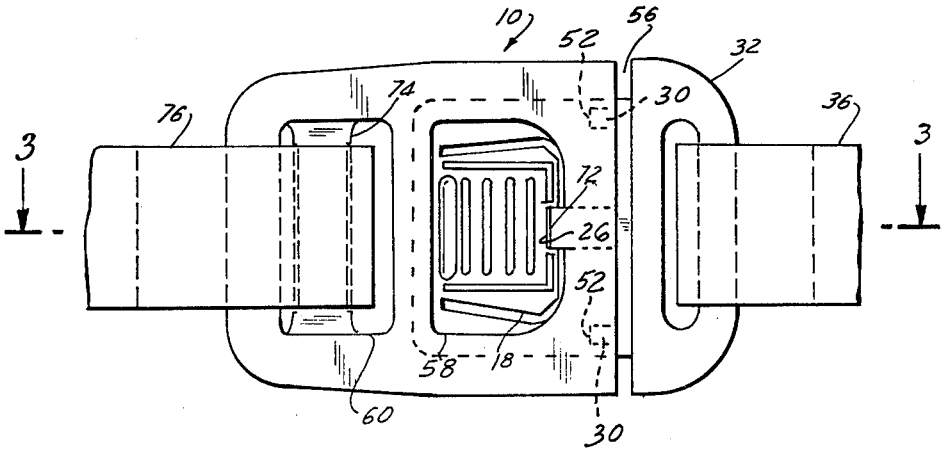
FIG. 2 is a plan view of an assembled buckle having a strap attached thereto.

A relatively thick slotted member 32 is provided at the end of the plate-like portion 16 adjacent the stops 30. The slot 34 is suitable for receiving a strap or belt 36 as shown in FIG. 2. The slotted member 32 may be formed integrally with the remainder of the male member 12, and defines a shoulder 38 on both sides of the plate-like portion 16. The width of the slotted member is also greater than the width of said portion 16, and extends laterally therefrom at both sides.

Figure 5:
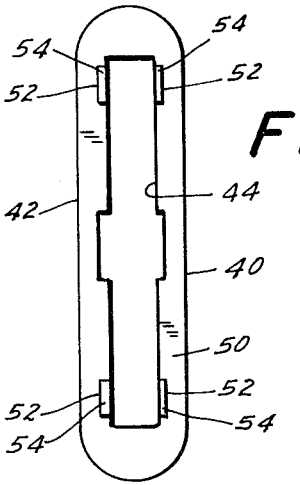
FIG. 5 is an end view of the female member of the buckle.

The female member 14 includes an opposing pair of parallel structures 40, 42 defining a rectangular slot 44 therebetween. Each parallel structure has a cross section of a wide U. When joined, they define a flattened housing having upper, lower, and side walls with the slot 44 extending longitudinally therethrough. One end 48 of the housing is closed. The other is open and defines an entrance 50 to the slot 44. FIG. 5 shows the configuration of the entrance 50.

The entrance 50 and slot 44 are designed for accommodating the plate-like portion 16 of the male member. The slot has large enough dimensions to permit easy insertion, but is not so large that there is excess play. Two pairs of notches 52 are provided near the entrance 50 for accommodating the stops 30. The notches are each defined by three side walls and a shoulder 54, and extend perpendicular to said slot. They have approximately the same shape as the stops, and serve to minimize lateral play of the male member. The stops and notches are positioned such that a gap 56 is created upon full insertion of the male member.

Each parallel structure 40, 42 is formed with a pair of openings 58, 60 separated by a crossing piece 62. The remainder of the upper face of each parallel structure includes front and rear lateral members 64, 66 and longitudinal members 68, 70. The parallel structures are integrally formed, and upon assembly, the openings are registrable.

A lip 72 extends rearwardly from the front lateral member 64 over a portion of the adjacent openings 58. The lip 72 is rectangular in shape so that it can fit within groove 26 upon insertion of the male member 12 within the slot 44. The projection 18 snaps towards the lip at groove 26 when the buckle is fully assembled. In this manner, it will not tend to slip over the front lateral member 64 when the buckle is subjected to high tensile forces. A portion of member 64 extends below the lip 72 to serve as an abutment.

Figure 3:
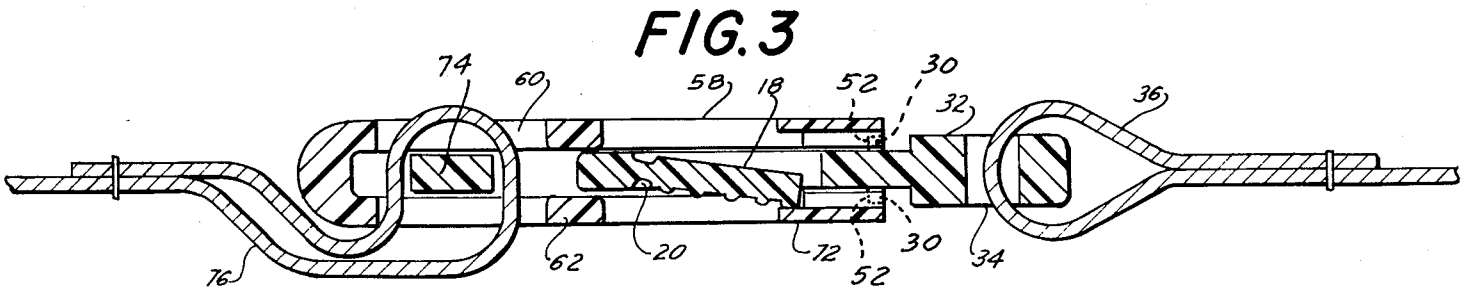
FIG. 3 is a sectional elevation view of the assembled buckle in use.

A free-moving column 74 having ridges 75 on opposite sides thereof is positioned within the slot 44 and in line with the rearward opening 60. The crossing piece 62 may be formed with a ridge (not shown) on its interior surface to prevent the column from moving beyond the opening 60. A strap or belt 76 may be looped around the column as shown in FIG. 3. The ridges 75 serve to prevent undesired loosening of the belt.

In operation, a pair of belts 36, 37 are secured to the male and female members 12, 14 respectively. Belt 36 is looped within slot 34 and belt 76 about column 74. The plate-like portion 16 of the male member is inserted within the slot 44, initially depressing the projection as ridges 24 contact the inner surface of lateral member 64. Once fully inserted, the projection snaps away from said plate-like member and towards the lip 72. The stops 30 fit within notches 52 and prevent excessive lateral movement of the male member.

Figure 4:
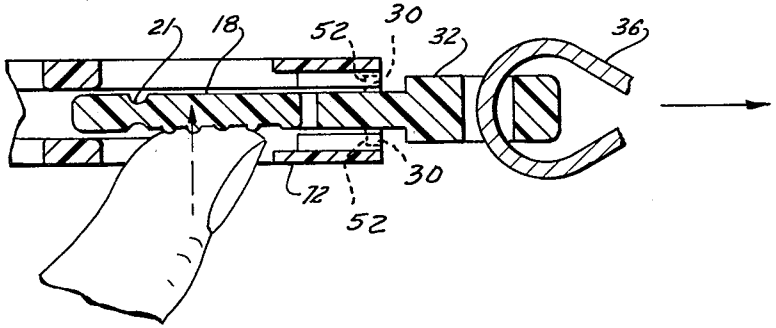
FIG. 4 is a sectional elevation view of the buckle showing the step of separating the male and female members of said buckle.

To separate the buckle, one applies pressure to the projection 18 as shown in FIG. 4. The projection is accessible through the opening 58 when the buckle is assembled. The pressure enables one to slide the male member from the slot as it will avoid contact with member 64. Ridges 22 facilitate the separation of the members.

It will be appreciated that the invention provides a buckle which is suitable for a variety of applications, including but not limited to restraint straps, belts in scuba and other diving equipment, and other uses. Although a somewhat preferred embodiment has been disclosed in the above specification and drawings, it should be interpretted as illustrative rather than limiting, and the scope of the invention is to be determined by reference to the appended claims.

What is claimed is:

1. A buckle comprising:

a female member having an upper wall, a lower wall, side walls interconnecting said upper and lower walls, and a slot defined by said walls and extending longitudinally through said member, said slot having an entrance at one end of said female member;

first and second openings within said upper wall, first and second openings in said lower wall registrable, respectively, with said first and second openings in said upper wall, one pair of registrable openings located nearer to said slot entrance than said other pair of registrable openings, and said pairs of registrable openings extending substantially perpendicular to said slot;

a lip member extending from a portion of said lower wall over part of said opening nearer said slot entrance, said lip extending in a direction away from said slot entrance, said lower wall having a surface extending further within said slot than any part of said lip, to form an abutment;

said slot entrance being defined by ends of said upper, lower, and side walls, and including a plurality of notches extending within said side walls and perpendicular to said slot;

a column positioned within and movable along said slot, said column positioned between said other pair of registrable openings which are further from said slot entrance than said one pair of registrable openings;

a male member having a portion thereof positioned within said slot, said male member including a plate-like portion having dimensions similar to those of said slot and inserted within said slot, and a slotted member connected to said plate-like portion positioned outside of said slot;

a projection extending at an acute angle from said plate-like portion, said projection having one end resiliently connected to said plate-like portion and a distal end positioned adjacent said lip in such a manner that it cannot emerge from said opening near the slot entrance, said distal end also being located in proximity to said abutment formed by said lower wall such that the male member cannot be moved longitudinally from said slot without contacting said abutment; and a plurality of stops protruding perpendicularly from said plate-like portion, said stops being positioned within said notches and having outer structural configurations corresponding to the inner structural configurations of said notches.

2. A buckle as defined in claim 1 wherein said notches have a square cross section.

3. A buckle as defined in claim 1 wherein said distal end of said projection includes a groove within which the lip is positioned.

4. A buckle as defined in claim 1 wherein said projection flares outwardly from its connection to said plate-like member to its distal end.

5. A buckle as defined in claim 1 wherein said slotted member is thicker and wider than said plate-like portion, said stops being positioned adjacent to said slotted member.

6. A buckle as defined in claim 1 or claim 3 wherein said lip is rectangular in shape.

* * * * *